US008428285B2

(12) United States Patent
Khamashta et al.

(10) Patent No.: US 8,428,285 B2
(45) Date of Patent: Apr. 23, 2013

(54) MICROPHONE SCREEN WITH COMMON MODE INTERFERENCE REDUCTION

(75) Inventors: Robert Khamashta, Los Gatos, CA (US); Ching Shyu, San Jose, CA (US); Dennis Fish, Santa Cruz, CA (US)

(73) Assignee: Plantronics, Inc., Santa Cruz, CA (US)

( * ) Notice: Subject to any disclaimer, the term of this patent is extended or adjusted under 35 U.S.C. 154(b) by 41 days.

(21) Appl. No.: 13/278,071

(22) Filed: Oct. 20, 2011

(65) Prior Publication Data

US 2012/0076338 A1 Mar. 29, 2012

Related U.S. Application Data

(62) Division of application No. 12/102,734, filed on Apr. 14, 2008, now abandoned.

(51) Int. Cl.
*H04R 9/08* (2006.01)

(52) U.S. Cl.
USPC ..... 381/355; 381/322; 381/360; 381/391

(58) Field of Classification Search ..... 381/355, 381/322, 360, 391
See application file for complete search history.

(56) References Cited

U.S. PATENT DOCUMENTS 7,349,547 B1 * 3/2008 Isvan ..... 381/104
7,881,486 B1 * 2/2011 Killion et al. ..... 381/313

* cited by examiner

*Primary Examiner* — Long Tran

(57) ABSTRACT

A microphone assembly includes a microphone composed of a case having an open end and a printed circuit board. The printed circuit board is disposed in the open case end. The microphone assembly further includes a metal screen coupled to the case over the printed circuit board for shielding the microphone from electromagnetic interference. The metal screen includes several apertures.

8 Claims, 9 Drawing Sheets

MICROPHONE SCREEN WITH COMMON MODE INTERFERENCE REDUCTION

RELATED APPLICATION

This application is a divisional application of application Ser. No. 12/102,734, filed Apr. 14, 2008, entitled "Microphone Screen With Common Mode Interference Reduction".

BACKGROUND OF THE INVENTION

In telecommunication systems, the phone handset or headset microphone is susceptible to common mode interference, such as power line interference noise signals or other electromagnetic radiation detected as noise or interference. This interference is commonly referred to as buzz and hum noise. The noise signals are fundamentally at 50-60 Hz and can also be associated with higher order frequency harmonics.

In the prior art, microphones use a metal enclosure to provide a measure of shielding from buzz and hum noise. Typically, the shielding is partially accomplished by mounting the microphone element in a cylindrical metal case or "can". The back of a noise canceling microphone is typically a printed circuit board (PCB) having two layers of copper. The conductive case provides shielding from the sides, but does not shield the back of the microphone. In the prior art, careful PCB design to obtain maximum ground (at zero voltage reference) coverage using the two copper layers provided improved shielding from the back side and thus improved noise immunity. However, the PCB metal traces forming the copper layers still do not typically provide a contiguous grounded copper shield due to normal gaps between traces. As a result of these gaps, which consist of non-conductive material, capacitive coupling through the PCB occurs for both omni-directional and noise-canceling microphones.

Where the PCB contains an acoustic port, as in noise-canceling microphones, this capacitive coupling is increased further. Referring to FIG. 11, a prior art noise canceling microphone assembly 1100 is illustrated. The microphone assembly includes a housing can 1101 (also referred to herein as a microphone case), a printed circuit board (PCB) 1110, and a microphone transducer. The microphone transducer is typically an Electret type microphone comprised of a charged metallized diaphragm 1104 forming one plate of a capacitor and a backplate 1106 forming the other plate with a dielectric disposed in between. The charge is typically provided by an Electret material disposed on the surface of the back plate. The dielectric consists of an air gap 1102 between diaphragm 1104 and backplate 1106. Sound impinging on the diaphragm causes the diaphragm to vibrate. Diaphragm vibration varies the capacitance and produces a voltage signal proportional to the pressure difference across the diaphragm. Such Electret microphones typically use an integrated circuit (IC) 1108 having a junction field effect transistor (JFET) disposed on a printed circuit board (PCB) 1110 to amplify the output of the Electret microphone and transform the very high impedance of the small capacitor formed by the Electret microphone to a more usable lower value without undue capacitive divider losses. The microphone backplate 1106 is coupled to the gate terminal of the junction field effect transistor. Prior art noise canceling microphone assembly 1100 has a primary port 1112 (also referred to herein as a front port) in a front surface and a cancellation port 1114 (also referred to herein as a back or rear port) in the back surface of the housing in the PCB 1110. The noise cancellation port 1114 extends from a first side of PCB 1110 to a second side of PCB 1110.

In one example of a prior art device, the housing can 1101 has an open end 1103 with PCB 1110 forming the face of the open end 1103. Face 1105 of PCB 1110 with terminals 1116, 1118 forms the external surface of open end 1103. Noise cancellation port 1114 is used to cancel out undesired ambient or background noise which arrives from a different angle and originates much farther from the microphone than the voice of the user. Sound waves that arrive at opposite sides of the diaphragm in equal phase and amplitude do not induce diaphragm vibration. This condition is referred to as acoustic cancellation. In headset applications, the microphone/boot assembly is oriented such that sound waves emanating from the desired sound source (user's mouth) reach the front face of the diaphragm earlier and with greater amplitude than they reach the rear face of the diaphragm. Thus, acoustic cancellation is minimized. In contrast, sound waves emanating from sound sources that are located far away and in other directions arrive at opposite sides of the diaphragm in more nearly the same phase and amplitude, resulting in more acoustic cancellation. Therefore, the microphone is less sensitive to ambient noise than to the user's voice. This phenomenon is referred to as "noise cancellation".

Thus, noise canceling Electret microphone 100 requires one or more acoustic ports on the back of the microphone. Since this acoustic port and the PCB output terminals cannot be easily covered with low cost PCB grounded shielding solutions, the overall shielding is compromised such that highly sensitive self-capacitance elements within the microphone are exposed to external noise influence. This electrical noise coupling is generally capacitive in nature. There are also forms of electromagnetic coupling from strong local radio frequency interference.

In the prior art, best practices in Electret microphone design and cable shielding could only reduce the hum and buzz from common mode interference (CMI) by roughly 6 to 10 dB. This proved to be not enough for host phone systems designed with high power line leakage potentials. Detectable low level audio hum and buzz continued to plague these microphone design efforts.

Thus, there is a need for improved methods and systems for electrical and electromagnetic interference shielding of Electret microphones without affecting acoustic operation of the microphone.

BRIEF DESCRIPTION OF THE DRAWINGS

The present invention will be readily understood by the following detailed description in conjunction with the accompanying drawings, wherein like reference numerals designate like structural elements.

DESCRIPTION OF SPECIFIC EMBODIMENTS

Figure 1:
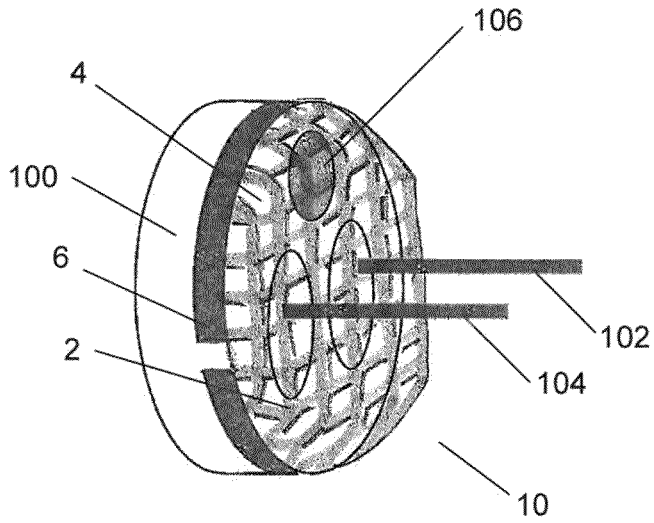
FIG. 1 illustrates a perspective view of a metal screen mounted on a microphone.

Methods and apparatuses for microphone assemblies are disclosed. The following description is presented to enable any person skilled in the art to make and use the invention. Descriptions of specific embodiments and applications are provided only as examples and various modifications will be readily apparent to those skilled in the art. The general principles defined herein may be applied to other embodiments and applications without departing from the spirit and scope of the invention. Thus, the present invention is to be accorded the widest scope encompassing numerous alternatives, modifications and equivalents consistent with the principles and features disclosed herein. For purpose of clarity, details relating to technical material that is known in the technical fields related to the invention have not been described in detail so as not to unnecessarily obscure the present invention.

Generally, this description describes a method and apparatus for a microphone assembly with improved shielding from electrical and electromagnetic interferences that create common mode noise signals (typically called Buzz and/or Hum). The microphone assembly may be either a noise canceling or omni-directional microphone. The invention relates generally to the fields of telephony, acoustics and electronics. The invention is applicable to communication headsets, including wireless and corded headsets. In addition to headsets, the invention is applicable to any device in which Electret microphones are used including, for example, singer microphones.

In one example of the invention, a headset microphone assembly includes a headset case and a microphone mounted within the headset case. The microphone case or 'can' consists of as a case with an open end covered by a printed circuit board. The printed circuit board is disposed in the open end of the case. A metal screen is coupled to the microphone case over the printed circuit board, where the metal screen is composed of a metal or conductive material having several apertures.

In a further example of the invention, a microphone assembly includes a microphone composed of a case having an open end and a printed circuit board. The printed circuit board is disposed in the open case. The microphone assembly further includes a metal screen coupled to the case over the printed circuit board for shielding the microphone from sources of interference. The metal or conductive screen includes several apertures.

In a further example of the invention, a microphone assembly includes a microphone composed of a case having an open end and a printed circuit board. The printed circuit board is disposed in the open case end. The microphone is enclosed with a front and rear "boot" system providing front and read acoustic ports. The rear boot is a conductive material, such as carbon impregnated rubber, that then shields the open case PCB end of the microphone from sources of interference.

In one example, a microphone system includes a microphone, a first microphone boot, and an electrically conductive second microphone boot. The microphone includes an electrically conductive microphone case, a printed circuit board that comprises an interior side facing an interior of the microphone case and an exterior side facing outwards, and a diaphragm disposed within the microphone case, where the diaphragm comprises a diaphragm first face and a diaphragm second face. A front microphone port is disposed in the microphone case acoustically coupled to the diaphragm first face. The first microphone boot is disposed about the microphone and includes a first boot port acoustically coupled to the front microphone port. The electrically conductive second microphone boot is electrically coupled to the electrically conductive microphone case.

In a further example, a microphone assembly includes a microphone and a metal ring electrically coupled to the microphone case. The microphone includes a microphone case having an open case end, and a printed circuit board, where the printed circuit board is disposed in the open case end. The metal ring extends beyond the open case end of the microphone, and shields the microphone from electromagnetic interference while allowing passage of an acoustic signal.

The present invention is applicable to a variety of different types of microphones and telecommunications devices. While the present invention is not necessarily limited to such devices, various aspects of the invention may be appreciated through a discussion of various examples using this context.

In one example of the invention, a metal screen is mounted onto a low cost microphone case or "can" technology of a common ECM (Electret Condenser Microphones). This screen retrofit will provide the ECM with electromagnetic interference protection but not affect the acoustic performance requirements. The metal material of the screen easily mounts to the metal case/can on the microphone, thus providing good electrical contact to signal ground.

The microphone assembly described herein offers several advantages over prior art designs. It provides a universal solution to retrofit existing microphone types and sizes, including noise canceling and omni-directional microphones. The assembly process is relatively simple, and retrofit cost is low due to the use of standard and readily available materials. Buzz and hum noise is reduced by approximately 30-40 dB at 50-60 Hz in one example.

Figure 2:
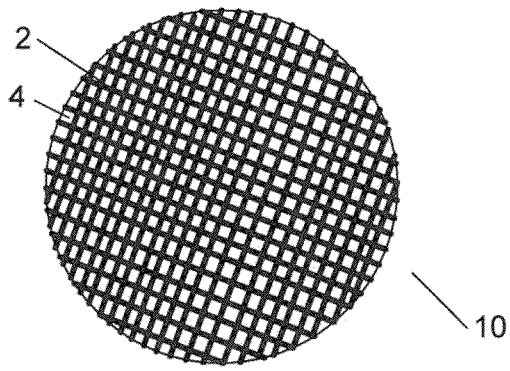
FIG. 2 illustrates a top view of the metal screen shown in FIG. 1.

FIG. 1 illustrates a metal screen 10 in one example of the invention in perspective view mounted to a noise canceling Electret condenser microphone 100. FIG. 2 illustrates a top view of metal screen 10. Metal screen 10 includes a metal wire screen (also referred to as a wire mesh) 2 having a plurality of apertures 4. Noise canceling Electret condenser microphone 100 has electrical wires 102, 104 exiting the metal screen 10 through two of the apertures 4. In one example, metal screen 10 is a metal wire screen 2 coupled with a spring type metal ring 6 provided to secure the metal screen 10 along the circumference of the noise canceling Electret condenser microphone 100.

Although the invention is usable in conjunction with a variety of microphones, the drawings illustrate an application of the invention with a noise canceling Electret condenser microphone. The noise canceling Electret condenser microphone appearing in FIG. 1 and other examples described herein may be replaced with an omni-directional microphone, as shielding from electrical and electromagnetic interferences that create common mode noise signals is improved in both noise canceling and omni-directional microphones.

The noise canceling Electret condenser microphone is formed from an open-ended metal case which is enclosed at the open end by a printed circuit board (PCB) carrying all the components needed for signal processing. An electrical connection is made between the printed circuit board and the microphone backplate to couple the electrical pulses from the diaphragm areas to electrical components for signal processing. The PCB may either be a rigid board such as glass epoxy FR-4 or a flex-circuit such as polymide.

The PCB contains at least two layers, of which one layer is substantially a power or ground plane. In conjunction with the metal case, the PCB provides electrical shielding of the integral electronics from electromagnetic interference. Electrical pads and/or terminals may be positioned on the PCB. The noise canceling Electret condenser microphone includes an acoustic port 106 to admit sound to the back side of the noise canceling Electret condenser microphone. Acoustic port 106 is an opening in the PCB.

The metal screen 10 covers the PCB (and thus, acoustic port 106) when mounted to noise canceling Electret condenser microphone 100. Spring type metal ring 6 (or similar mounting structures such as flanges) is utilized to hold the metal screen 10 in its desired position to the noise canceling ECM. The diameter of the spring type metal ring 6 may be adapted to fit a variety of ECM case sizes.

In one example, the total area of the apertures 4 is at least 200% of the area of the rear acoustic port 106 opening to provide optimal shielding. No minimum is required for omni-directional microphones without rear port openings. In one example, the maximum total area of apertures 4 is up to 60% of the area of the PCB being covered to provide optimal shielding. In a further example, the size of apertures 4 is approximately 0.5 millimeters in diameter. The selection of the size of apertures 4 is balanced between selecting smaller diameters, which provide improved shielding results, while still maintaining sufficiently large diameters so that the desired noise canceling microphone frequency response is not greatly affected.

The metal wire screen 2 is manufactured from an electrically conductive material to shield the noise canceling Electret condenser microphone 100 from electromagnetic interference such as common mode interference. Preferably the metal wire screen 2 is made from steel, copper, or tin. However, any metal conductor may be used. The thickness of metal wire screen 2 may be varied. For example, a thin metal foil may be used. The wire screen 2 operates to block common mode interference signals from entering the acoustic port 106, while being acoustically transparent to allow the passage of sound through the wire screen apertures 4 and acoustic port 106. In an example where the microphone 100 is replaced with an omni-directional Electret microphone, the wire screen 2 operates to cover the PCB gaps in the PCB shielding to reduce or eliminate parasitic capacitive coupling to the case internal capacitances.

Spring type metal ring 6 is a ring with an inside diameter that corresponds to the outside diameter of the noise canceling ECM case. Spring type metal ring 6 is an electrically conductive metal, and when attached to the noise canceling ECM case, forms an electrical connection to aid in interference shielding.

The above-described metal screen 10 is generally planar; other shapes and configurations of the metal screen 10 may also be employed to provide the desired electromagnetic interference shielding, including, e.g., a cylindrical, dome shaped or spherical metal screen, or any other suitable shape. In further examples, metal screen 10 may surround the entire noise canceling Electret condenser microphone case rather than just the PCB. Desirably the metal screen 10 is of a size, shape and orientation sufficient to effectively shield the microphone from surrounding electromagnetic interference.

Figure 3:
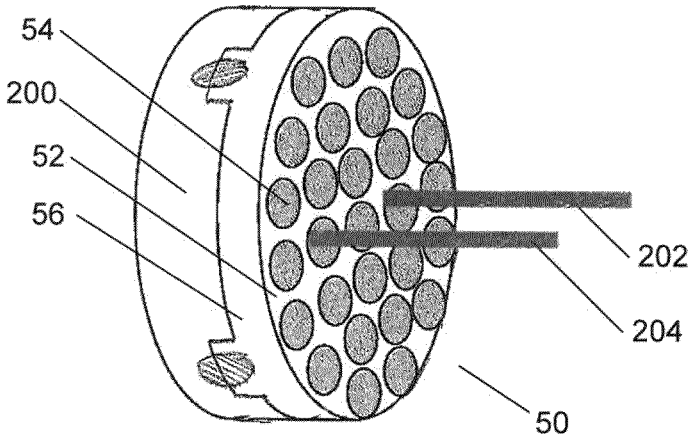
FIG. 3 illustrates a perspective view of metal screen mounted on a microphone in a further example.
Figure 4:
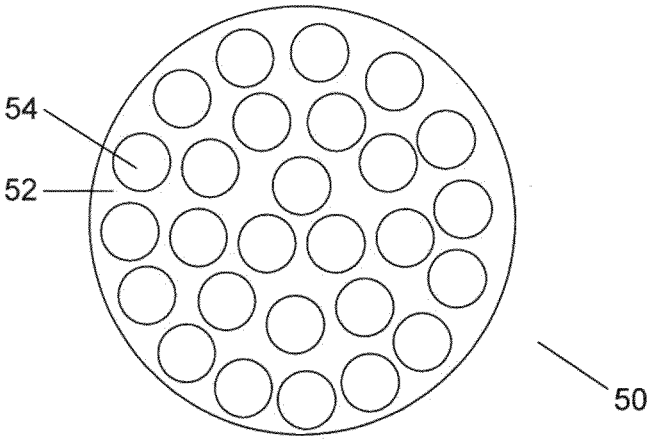
FIG. 4 illustrates a top view of the metal screen shown in FIG. 3.

FIG. 3 illustrates a metal screen 50 of the invention in perspective view mounted to a noise canceling Electret condenser microphone 200 in a further example. FIG. 4 illustrates a top view of metal screen 50. Noise canceling Electret condenser microphone 200 has electrical wires 202, 204 exiting the metal screen 50 through two of the screen apertures 54. The metal screen 50 is a perforated structure 52 constructed of thin sheet metal with a plurality of metal screen apertures 54. For example, the metal screen apertures 54 may be punched or cut out to form a mechanical design that grips or crimps over the back of the microphone with a combination of formed legs. The leg mounts could also use edge soldering for attachment to the standard ECM construction. The edges of the metal screen 50 may be crimped so as to form a ring 56 to secure the metal screen 50 to the noise canceling Electret condenser microphone 200 along the circumference of the noise canceling Electret condenser microphone 200.

Although the invention is usable in conjunction with a variety of microphones, the drawings illustrate an application of the invention with a noise canceling Electret condenser microphone 200. As described previously, noise canceling Electret condenser microphone 200 may be replaced with an omni-directional Electret condenser microphone. Similar to the noise canceling Electret condenser microphone described in reference to FIG. 1, noise canceling Electret condenser microphone 200 is formed from an open-ended metal case which is enclosed at the open end by a printed circuit board (PCB) carrying all the components needed for signal processing. An electrical connection is made between the printed circuit board and the microphone backplate for coupling the electrical pulses from the diaphragm areas to electrical components for signal processing. In addition, the PCB has a ground plane connected to the metal case to provide electromagnetic interference shielding. Noise canceling Electret condenser microphone 200 includes an acoustic port (not shown) to admit sound to the back side of the noise canceling Electret condenser microphone 200. The acoustic port is an opening in the PCB. The PCB may either be a rigid board such as glass epoxy FR-4 or a flex-circuit such as polymide. The metal screen 50 covers the PCB when mounted to noise canceling Electret condenser microphone 200.

The metal screen 50 is manufactured from an electrically conductive sheet metal to shield the noise canceling Electret condenser microphone 200 from electromagnetic interference. Preferably the metal screen 50 is made from steel, copper, or tin. However, any metal conductor or semiconductor of varying thickness may be used. Use of such material facilitates blocking of common mode interference through the presence of the metal conductor while allowing passage of sound (i.e., it is acoustically transparent) through the apertures. Although shown as circular apertures, other shaped apertures may be used.

In one example, the total area of the apertures 54 is at least 200% of the area of the rear acoustic port opening to provide optimal shielding. No minimum is required for omni-directional microphones without rear port openings. In one example, the maximum total area of apertures 54 is up to 60% of the area of the PCB being covered to provide optimal shielding. In a further example, the size of apertures 54 is approximately 0.5 millimeters in diameter. However, the size of the apertures may be varied in further examples.

Ring 56 has an inside diameter that corresponds to the outside diameter of the noise canceling ECM case. Ring 56 is electrically conductive, and when attached to the noise canceling ECM case, forms an electrical connection.

The above-described metal screen 50 is generally planar; other shapes and configurations of the metal screen 50 may also be employed to provide the desired electromagnetic interference shielding, including, e.g., a cylindrical, dome shaped or spherical metal screen, or any other suitable shape. In further examples, metal screen 50 may surround the entire noise canceling Electret condenser microphone 200 case rather than just the PCB. The metal screen 50 is of a size, shape and orientation sufficient to effectively shield the microphone from electromagnetic interference.

Figure 7:
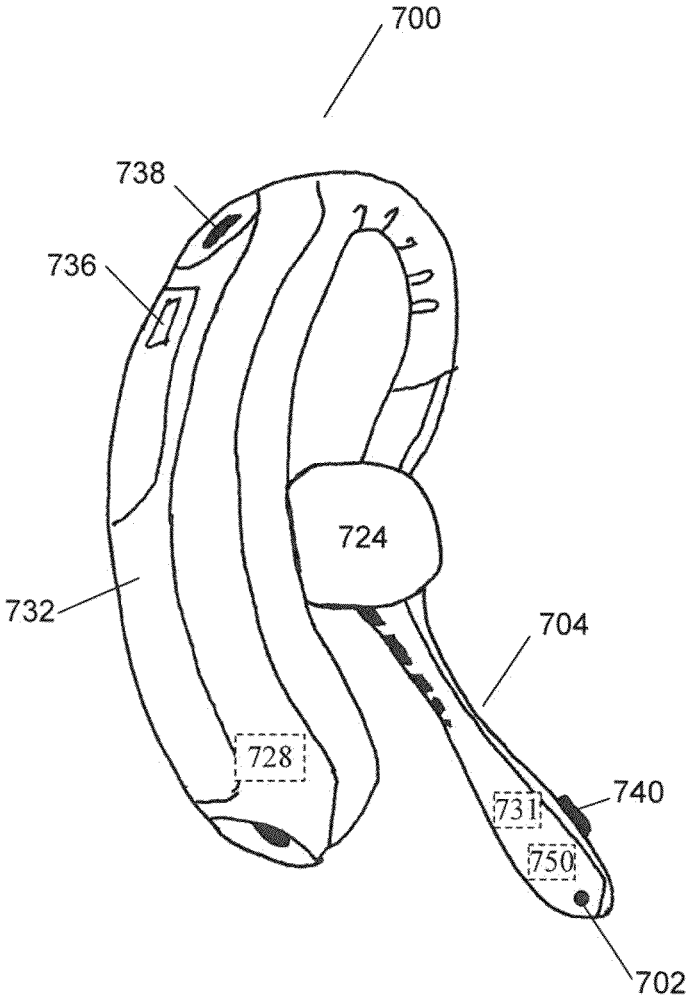
FIG. 7 illustrates a typical headset with which the metal screen mounted on a microphone illustrated in FIG. 1 or FIG. 3 may be implemented.

FIG. 7 illustrates an over-the-ear type headset 700 with which noise canceling Electret condenser microphone 100 and metal screen 10 may be employed, or noise canceling Electret condenser microphone 200 and metal screen 50 may be employed.

The headset 700 includes a speaker 724, a microphone assembly 750, a user interface 738, status indicator 736, and a wireless communication module 731 (where headset 700 is a wireless headset) installed within a case of the headset 700. The user interface 738 may include a multifunction power, volume, mute, and select button or buttons. Other user interfaces may be included on the headset, such as a link active/end interface 740. It will be appreciated that numerous other configurations exist for the user interface. The particular button or buttons and their locations are not critical to the present invention.

The headset 700 includes a boom 704 with the microphone assembly 750 installed at the lower end of the boom. The main case of the headset may be in the shape of a loop 732 to be worn behind a user's ear. In the example where headset 700 is wireless, the headset 700 further includes a power source such as a rechargeable battery 728 installed within the case.

The headset 700 includes a microphone port 702 through which sound may be admitted to a location containing a microphone assembly 750. For example, microphone assembly 750 may consist of noise canceling Electret condenser microphone 100 coupled with metal screen 10. While the microphone port 702 and microphone assembly 750 are illustrated as appearing in the far end of the headset boom 704, it will be appreciated that the microphone may be located at any suitable position in the headset. For example, frequently microphones are mounted in near end of the headset boom 704. Also, while FIG. 7 depicts one particular headset form, the invention may be employed with other types of headset form factors and other devices such as handsets where buzz and hum noise may be a problem.

Figure 5:
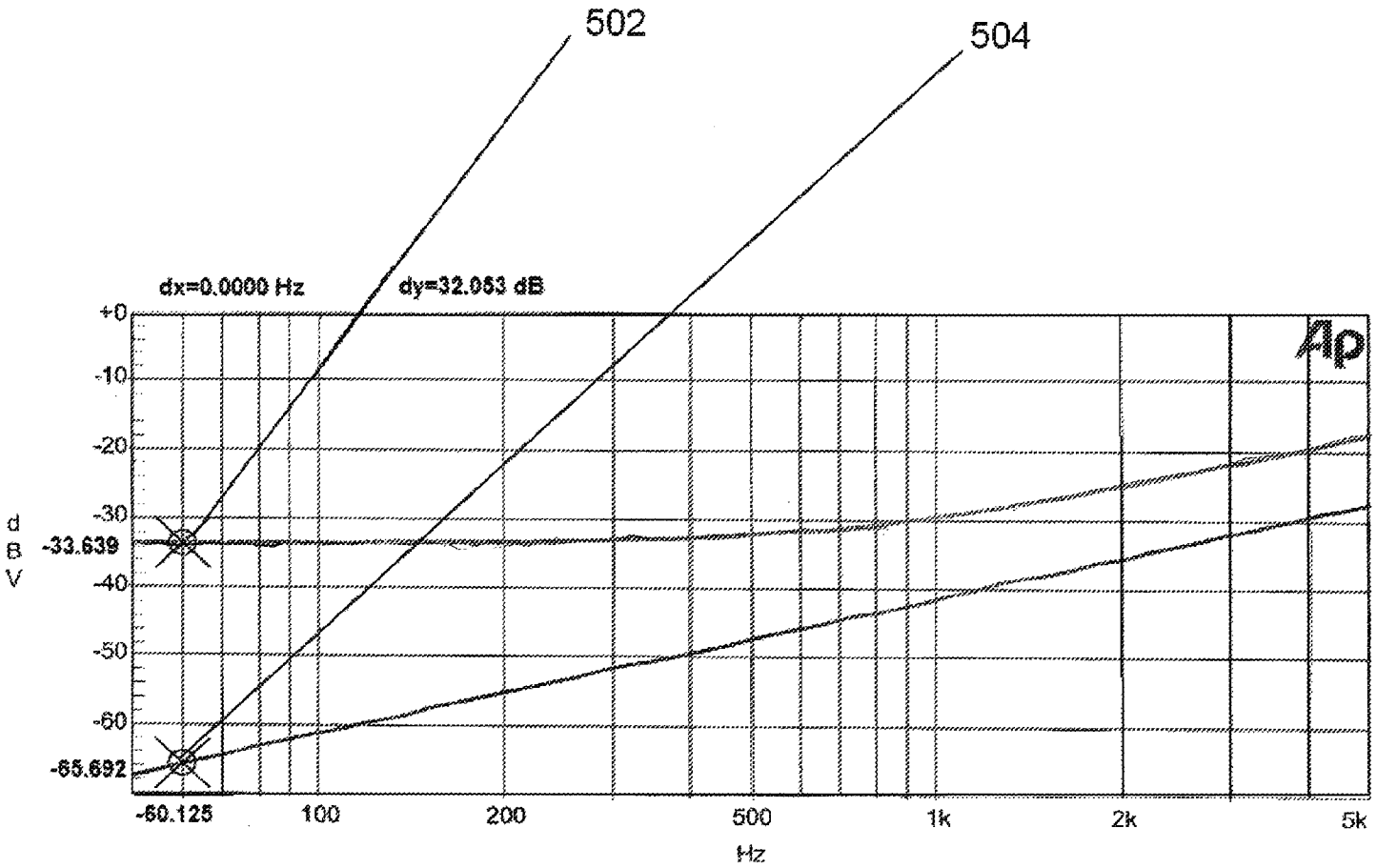
FIG. 5 is a plot of sample test results of the common-mode rejection ratio for a microphone with and without the microphone screen shown in FIG. 1.

FIG. 5 is a graph plotting sample test results of the common-mode rejection ratio for an ECM with and without the microphone metal screen 10 shown in FIGS. 1 and 2. Plot 502 is for an ECM without microphone metal screen 10 and plot 504 is for an ECM with microphone metal screen 10. As can be understood from FIG. 5, the common mode interference is reduced significantly by the use of microphone metal screen 10, improving by approximately 32 dB at 60.125 Hz.

Figure 6:
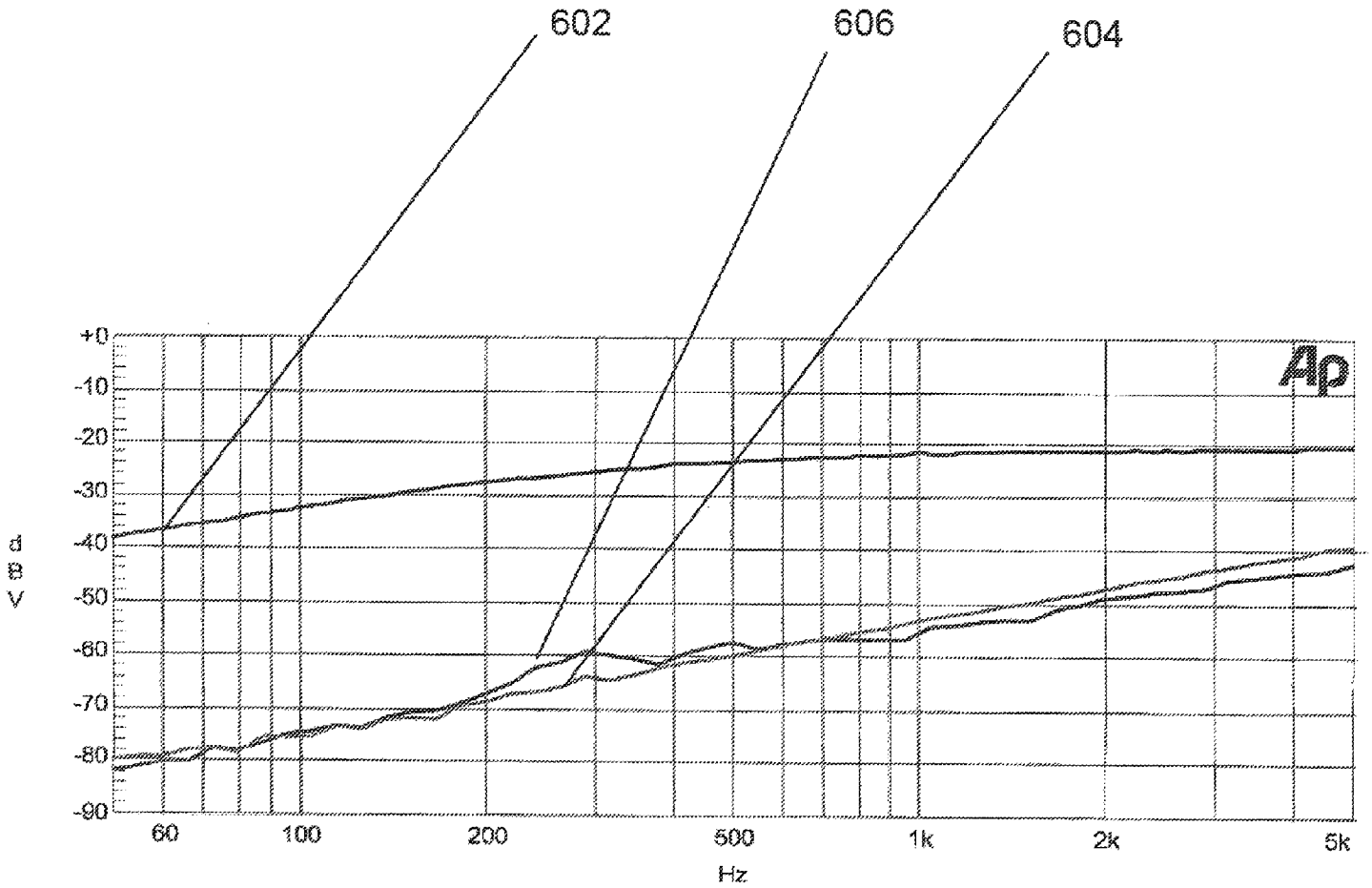
FIG. 6 is a plot of sample test results of the common-mode rejection ratio for a microphone with and without the microphone screen shown in FIG. 3.

Similarly, FIG. 6 is a graph plotting sample test results of the common-mode rejection ratio for an ECM with and without the microphone metal screen 50 shown in FIGS. 3 and 4. Plot 602 is for an ECM without microphone metal screen 50 and plots 604 and 606 are for an ECM with microphone metal screen 50. As can be understood from FIG. 6, the common mode interference is reduced significantly by the use of microphone metal screen 50, improving by approximately 44 dB at 60 Hz. Thus, use of microphone metal screen 10 and microphone screen 50 showed significant improvement in reducing microphone hum and buzz resulting from common mode interference.

Figure 8:
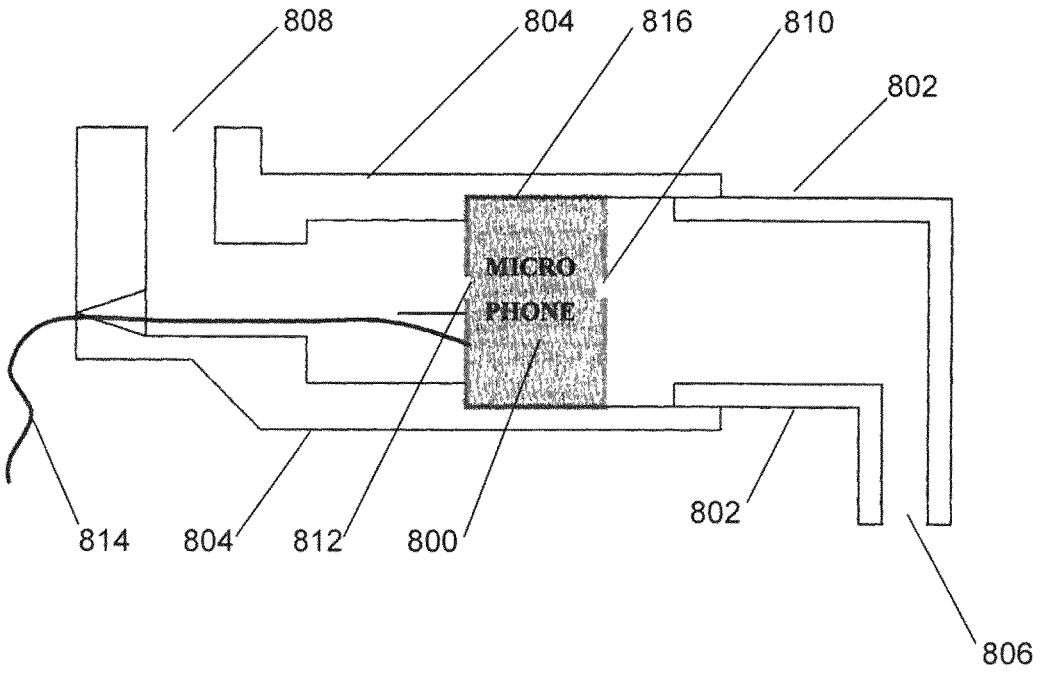
FIG. 8 illustrates a rear-conductive "boot" enclosure as an alternative shield material and method.

FIG. 8 illustrates a rear-conductive "boot" enclosure as an alternative shield material and method. A noise canceling Electret condenser microphone 800 utilizes a conductive microphone case 816 and includes a front port 810 and a rear port 812. As indicated earlier, an omni-directional microphone may be used in place of noise canceling Electret condenser microphone 800. A front boot 802 includes a port 806 leading to front port 810. Front boot 802 may, for example, be made from a urethane material. A rear boot 804 composed of an electrically conductive rubber material includes a port 808 leading to rear port 812. For example, rear boot 804 may be composed of a carbon impregnated rubber material. The electrically conductive rubber material forms a right acoustic seal and electrical connection to noise canceling Electret condenser microphone 800. In one example, the resistivity of the conductive material is up to 2000 ohms per square area to provide optimal shielding. As an alternate to a permeable/uniform conductive material to form the rear boot 804, the rear boot 804 may be a non-conductive (i.e. plastic) material with a conductive paint or a plating finish on the inner surfaces of the rear boot 804. The conductive microphone case 816 must maintain electrical connection to the conductive material of the rear boot 804 or the conductive inner surfaces of the rear boot 804. Rear boot 804 may include a tight slot or cut to allow for the exit of microphone leads 814.

Figure 9:
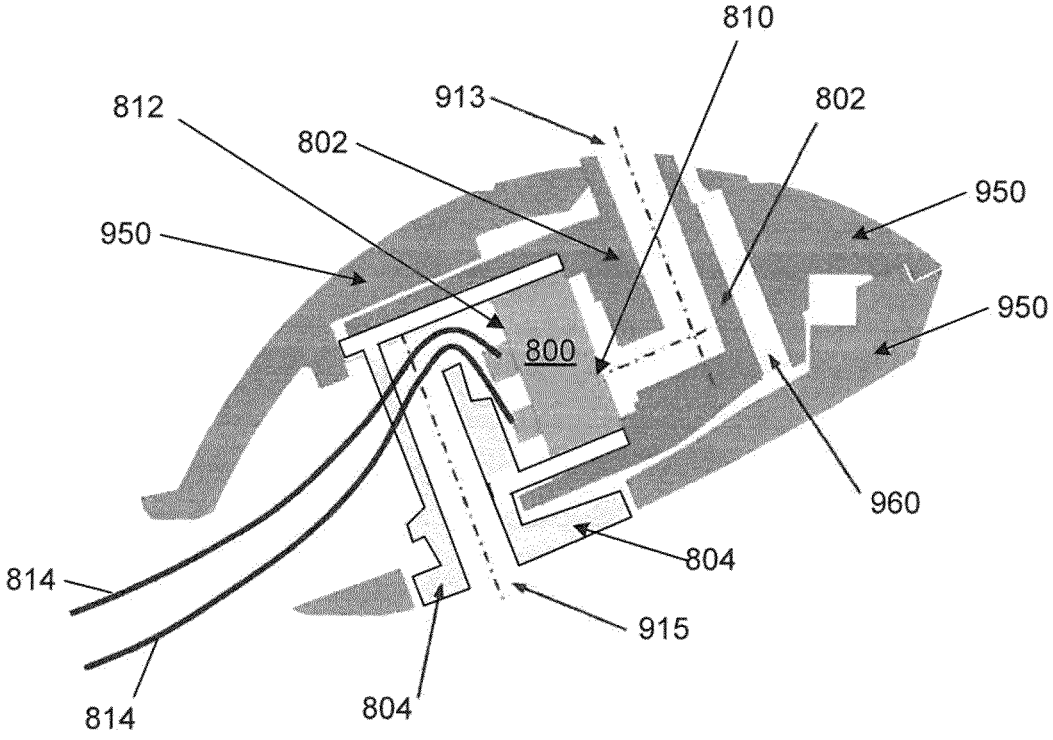
FIG. 9 illustrates the rear conductive boot enclosure shown in FIG. 8 in use with a headset case.

FIG. 9 illustrates the rear conductive boot enclosure shown in FIG. 8 in use with a headset case 950 such as a headset boom case. Referring to FIG. 9, the microphone front port 810 and cancellation rear port 812 are acoustically connected with corresponding headset case ports 913, 915 via two microphone boots, the front boot 802 and the electrically conductive rear boot 804. Front boot 802 and rear boot 804 may contain front and rear acoustic cavities adjacent to the corresponding surfaces of the microphone. An acoustic seal is created around the microphone leads 814 as they pass through the rear boot 804. A compression pad 960 maintains a force between the front boot 802 and rear boot 804 and the noise canceling Electret condenser microphone 800 so that an adequate acoustic seal can be maintained between their mating surfaces.

Figure 10:
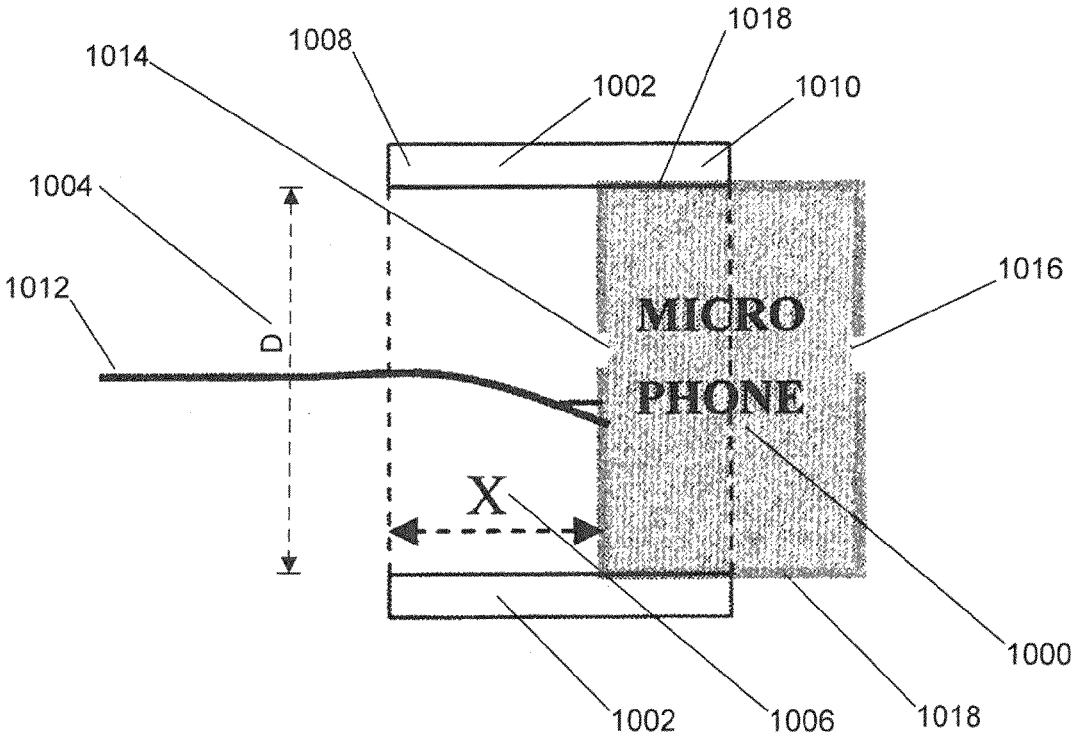
FIG. 10 illustrates a rear-conductive or metal ring as an alternative partial shielding method.
Figure 11:
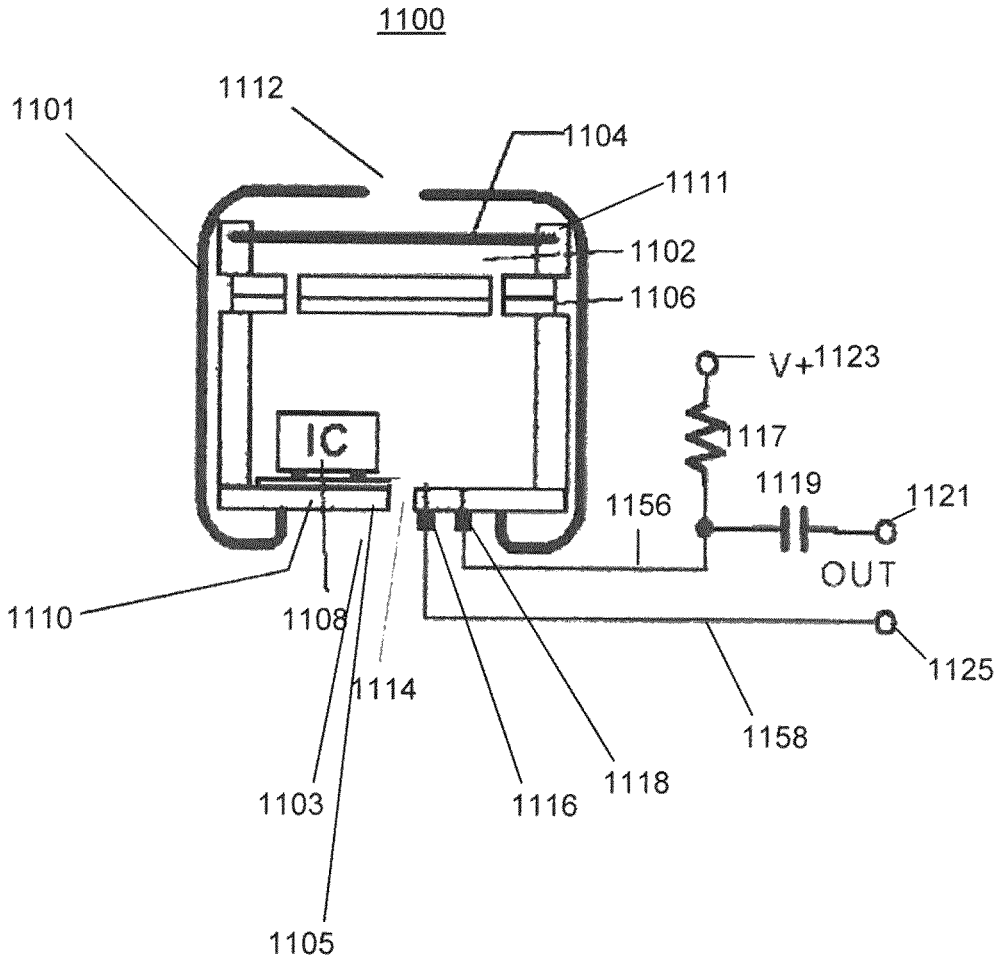
FIG. 11 (prior art)
FIG. 11 illustrates a prior art noise canceling microphone

FIG. 10 illustrates a rear-conductive ring 1002 as an alternative partial shielding method attached to a microphone assembly 1000 having a front port 1016 and a rear port 1014. In a further example, microphone assembly 1000 has only a front port 1016. The rear-conductive ring 1002 may be composed of any conductive material, including metal materials. The rear conductive ring 1002 includes an open end 1008 leading to rear port 1014, and a mating end 1010 electrically coupled to a microphone case 1018 of microphone assembly 1000. The conductive ring 1002 is mounted to the microphone case 1018 so that it extends a distance 'x' 1006 beyond the lower end of the microphone case 1018 having the PCB. An inner conductive ring diameter 1004 is slightly larger than the outer diameter of microphone case 1018 so that the conductive ring 1002 engages microphone case 1018 in a friction fit. In one example, conductive ring 1002 is a spring type metal ring which mounts over the noise canceling ECM case in a desired position. The diameter of the conductive ring 1002 may be adapted to fit a variety of ECM case sizes.

This alternative apparatus and method provides improvement to immunity but is not as effective as a screen or mesh fully enclosing the rear of the microphone assembly 1000. The conductive ring 1002 establishes increased distance, and thus reduced coupling, to the self-capacitance elements of the microphone assembly. In one example, the distance 'x' 1006 with which the conductive ring 1002 extends beyond the lower end of microphone case 1018 is at least 75% of the diameter of the microphone case 1018 lower end or the PCB disposed at the lower end to provide optimal shielding. Leads 1012 extend from the PCB disposed at the lower end.

The various examples described above are provided by way of illustration only and should not be construed to limit the invention. Based on the above discussion and illustrations, those skilled in the art will readily recognize that various modifications and changes may be made to the present invention without strictly following the exemplary embodiments and applications illustrated and described herein. Such modifications and changes do not depart from the true spirit and scope of the present invention that is set forth in the following claims.

While the exemplary embodiments of the present invention are described and illustrated herein, it will be appreciated that they are merely illustrative and that modifications can be made to these embodiments without departing from the spirit and scope of the invention. Thus, the scope of the invention is intended to be defined only in terms of the following claims as may be amended, with each claim being expressly incorporated into this Description of Specific Embodiments as an embodiment of the invention.

What is claimed is:

1. A microphone system comprising:

a microphone comprising:

an electrically conductive microphone case;

a printed circuit board that comprises an interior side facing an interior of the electrically conductive microphone case and an exterior side facing outwards;

a diaphragm disposed within the electrically conductive microphone case, wherein the diaphragm comprises a diaphragm first face and a diaphragm second face;

a rear microphone port disposed in the printed circuit board and that is acoustically coupled to the diaphragm second face;

a front microphone port disposed in the electrically conductive microphone case acoustically coupled to the diaphragm first face; and a first microphone boot disposed about the microphone comprising a first boot port acoustically coupled to the front microphone port; and an electrically conductive second microphone boot electrically coupled to the electrically conductive microphone case, wherein the electrically conductive second microphone boot comprises a second boot port acoustically coupled to the rear microphone port.

2. The microphone system of claim 1, wherein the electrically conductive second microphone boot has a resistivity up to 2000 ohms per square area.

3. The microphone system of claim 1, wherein the electrically conductive second microphone boot comprises carbon impregnated rubber.

4. The microphone system of claim 1, wherein the electrically conductive second microphone boot comprises a non-electrically conductive material with an electrically conductive coating.

5. The microphone system of claim 1, wherein the first microphone boot comprises a urethane material.

6. A headset comprising the microphone system of claim 1.

7. The microphone system of claim 1, wherein first microphone boot comprises an acoustic cavity.

8. The microphone system of claim 1, wherein the electrically conductive second microphone boot comprises an acoustic cavity.

* * * * *